United States Patent [19]

Meihofer

[11] 4,159,808

[45] Jul. 3, 1979

[54] VARIABLE RATIO WINDER

[75] Inventor: Edward F. Meihofer, Norfolk, Mass.

[73] Assignee: Butler Automatic, Inc., Canton, Mass.

[21] Appl. No.: 867,385

[22] Filed: Jan. 6, 1978

[51] Int. Cl.[2] ..... B65H 59/38

[52] U.S. Cl. ..... 242/75.51

[58] Field of Search ..... 242/75.51, 75.52, 75.53, 242/75, 67.1 R

[56] References Cited

U.S. PATENT DOCUMENTS

| | | | |
|---|---|---|---|
| 3,365,143 | 1/1968 | Espel | 242/75.51 |
| 3,441,825 | 4/1969 | Dinger | 242/75.52 |
| 3,595,495 | 7/1971 | Cloeren | 242/75.51 |
| 3,650,490 | 3/1972 | Saunders | 242/75.51 |

*Primary Examiner*—Edward J. McCarthy
*Attorney, Agent, or Firm*—Cesari and McKenna

[57] ABSTRACT

A web winder of the center wind type drives the web roll through a controllable variable speed mechanical transmission whose input shaft is turned by a variable slip torque modulating device whose torque coupling varies in accordance with the output of a web tension sensor upstream from the web roll to immediately change the angular velocity of the roll to compensate for sudden tension upsets in the web. The amount of slip in that device is detected and compared with a selected reference slip to develop an error signal for controlling the gear-in ratio of the transmission which slows the angular velocity of the roll to compensate for the gradual web tension increase caused by increasing roll size. Thus the winder's speed characteristics are matched at the input of the transmission to the clutch characteristics at all roll diameters so that the winder requires only a minimum size torque modulating device for given web speed and tension conditions.

8 Claims, 1 Drawing Figure

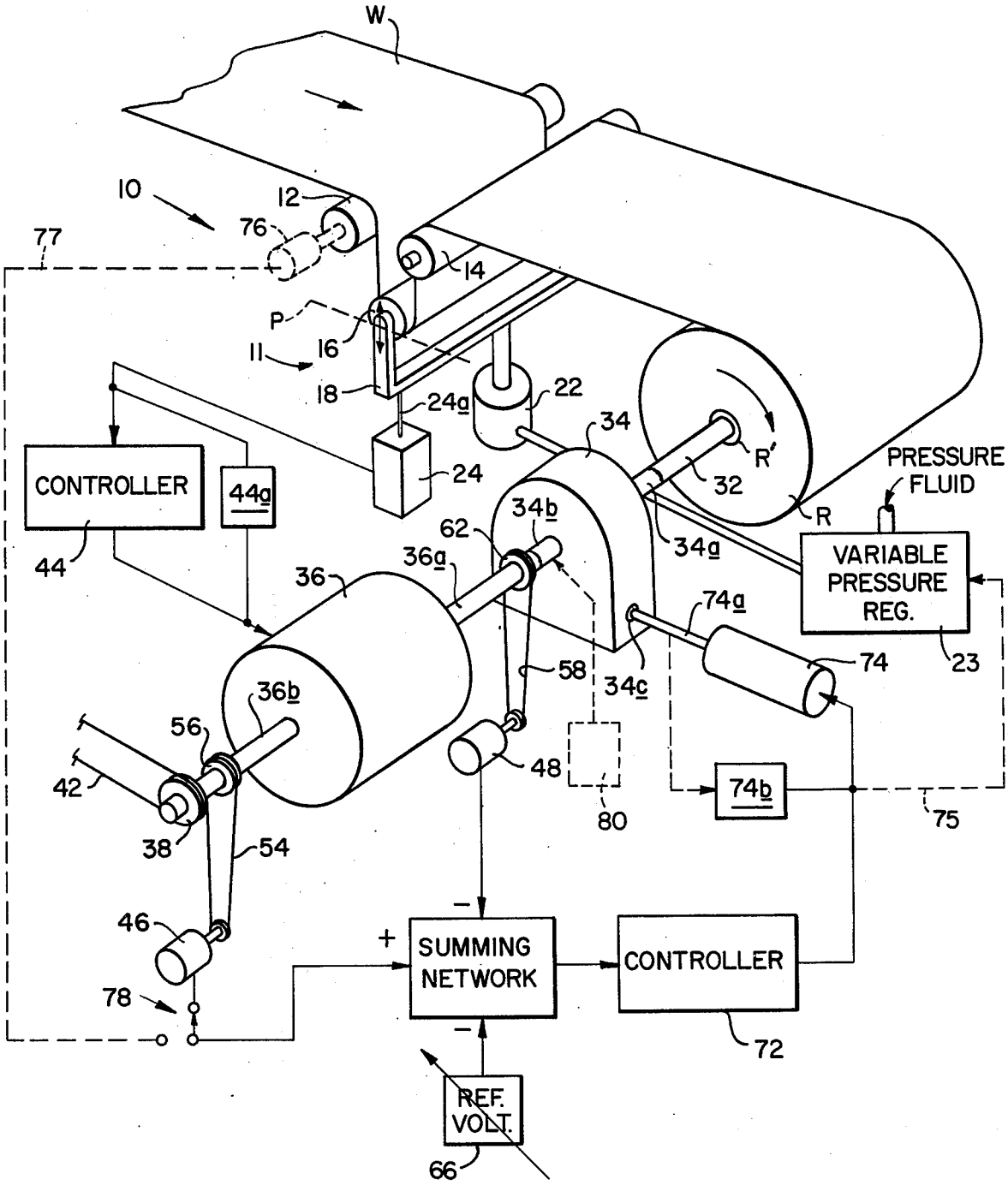
W
10
12
76
77
14
P
16
11
18
24a
22
34
R'
32
PRESSURE FLUID
R
CONTROLLER
44a
24
34b
62
36a
34a
VARIABLE PRESSURE REG.
44
36
74a
74
23
58
34c
36b
56
48
42
80
74b
75
38
54
46
SUMMING NETWORK
CONTROLLER
78
72
REF. VOLT.
66

VARIABLE RATIO WINDER

BACKGROUND OF THE INVENTION

This invention relates to apparatus for winding web. It relates more particularly to winding apparatus which maintains constant tension in the web during the winding operation.

A web winder is a machine which winds up the output of a web producing machine into a roll. For example, a winder may be positioned to receive printed web from a printing press. Sometimes the web winder may include a splicer so that a succession of webs of finite length can be wound up continuously on the same roll. An example of such a winder is disclosed in U.S. Pat. No. 3,756,526 owned by the assignee of the present application.

In web winders generally, it is desirable to maintain constant tension in the web span between the web producing machine and the building web roll. Consequently, the web is trained through a tension sensing device such as a force-loaded dancer positioned between the web producing machine and the web roll. Web tension upsets cause the dancer to move from a selected reference position reflecting the desired web tension. These movements are sensed and used to increase or decrease the speed of the motive means driving the winding web roll as needed to maintain the dancer at its reference position thus compensating for the tension upset. For example, if web tension increases, the dancer is moved from its reference position in one direction. This displacement is sensed and a control signal is applied to the motive means causing it to slow down. This reduces the tension in the web with the result that the dancer returns to its reference position. Conversely, if the tension in the web decreases, the dancer moves in the opposite direction causing the motive means to speed up sufficiently to return the dancer to its reference position.

Winders may be classified into two general types, namely, surface winders and center winders. In the former, a driven roll engages the outermost convolution of the building web roll. In the absence of a web tension upset, the surface speed of the driven roll remains constant as the radius of the building roll increases. In the center winder, with which we are concerned here, however, the core chucks or spindle on which the web is being wound is given a velocity and torque such as to impart a constant tension or a selected tension taper to the web. In the center winder, then, the web surface speed and therefore its tension will vary depending upon the roll radius. Consequently, a center winder drive is required to impart torque and angular velocity to the winding roll that are dependent upon the roll radius. That is, the winder drive requires increasing torque at decreasing angular velocity to maintain selected web tension and surface speed conditions.

Since material issuing from a web producing machine is ordinarily approaching the winder at a fixed velocity, the constant web tension winding requirement is equivalent to a constant winder horsepower because the horsepower is proportional to the product of web velocity and web tension. Thus, while the winding horsepower of a center winder remains constant, the drive that provides it must be capable of supplying both a much larger torque and a higher speed than is required by the surface winder in order to properly drive the roll at both roll radius extremes.

If the winding operation is performed by an electric motor coupled to the core shaft or spindle either directly or through a constant mechanical transmission ratio, then the size of the motor will be determined by the maximum torque that must be provided when the roll is full. In most instances, then, this will dictate a motor horsepower rating substantially greater than the horsepower that must actually be delivered to the core chuck or spindle and the ancillary control electronics capable of handling the larger motor.

This maximum horsepower requirement can be reduced to some degree by taking advantage of the desirability of winding the rolls with a tension taper, i.e., a higher web tension at the core than at the surface of the completed roll, and also by such techniques as field weakening in the winder drive motor. However, even the use of such measures does not suffice to overcome the need for an oversized winder drive. As an example, a web roll is typically wound with a build-up ratio of maximum diameter to core diameter of 10 or 12 to 1. An optimum tension taper may be in the range of 1.5 to 2. Motor field weakening can produce an overspeed of a large DC motor on the order of 1.5 times its full torque rated speed. However, although such a technique can provide for a constant horsepower range of up to 6 to 1, the motor size and therefore its cost is still dictated by the maximum torque requirement, which results in a motor frame size capable of 6 times the motor horsepower rating based on full field low RPM operation.

To overcome the aforesaid limitation, various types of variable ratio transmission devices have been incorporated into web winders of this general type. For example, gear shifting devices which provide a plurality of fixed ratios have been used. However, such devices involve an inherent discontinuity in the winding process when changing from one ratio to another which produces web tension upsets. Therefore, these types of devices are usually unacceptable for most continuous web winding applications.

There do exist continuous variable ratio transmissions such as the so-called Variator which avoid such discontinuities. While these have been tried in web winders, their operation has not been entirely satisfactory because they are quite difficult to control by the usual web tension sensing devices. That is, when typical tension sensors such as dancer rollers, tension transducers and the like are used, they are difficult or nearly impossible to interface with such continuously variable speed transmissions due to the slow response of the transmission's speed control. Consequently, such mechanical transmissions have not found wide application in web winding apparatus.

SUMMARY OF THE INVENTION

Accordingly, it is an object of the present invention to provide web winding apparatus which provides superior control over the tension in the web.

A further object of the invention is to provide web winding apparatus which responds very quickly to web tension upsets.

Yet another object of the invention is to provide web winding apparatus that can utilize a conventional mechanical transmission for regulating the speed of the winding roll without any appreciable sacrifice in web tension control.

Another object is to provide such apparatus with a drive means of minimum size for given web velocity and tension conditions.

A further object of the invention is to provide apparatus of this type which can automatically impart a selected tension taper to the web being wound.

Another object of the invention is to provide apparatus of this type which can utilize the prime mover of the web producing machine in such a way as to minimize the use of power from external sources.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the winding apparatus of this invention employs a center-type drive in that it turns the winding roll core by way of core chucks or a spindle to which the core is secured. The web arriving at the apparatus from a web producing machine passes through a conventional dancer assembly that senses tension changes in the web as it is being wound on the roll.

The motive means for the driving roll includes a conventional continuously variable speed mechanical transmission whose output shaft drives the core of the winding roll. The torque input to the transmission is provided by a device capable of continuous torque modulation in response to an electrical input. For example, this device may be a DC motor or a variable slip clutch, the latter of which receives its torque input from the prime mover of the web producing machine.

The apparatus includes two servocontrol loops namely a tension control loop and a ratio control loop.

The dancer assembly which is in the tension control loop includes a dancer roller which is force-loaded to a selected reference position indicative of a selected web tension. Tension changes in the web downstream from the dancer roller due to upsets or changing winding roll size are reflected as excursions of the dancer roller from its reference position. These movements are sensed and converted to electrical signals which are used to control the current in the torque modulator connected to the input of the mechanical transmission.

The ratio control loop comprises means such as a tachometer for measuring the output angular velocity of the torque modulating device. This velocity is subtracted from a reference velocity proportional to the speed of the web entering the winding apparatus. If the torque modulator is a motor, the reference velocity can be measured by a tachometer rotating with a fixed diameter roll upstream from the dancer. On the other hand, if the modulator is a variable slip clutch, then the reference velocity can be measured by a tachometer connected to the input shaft of the clutch. In any event, the outputs of the two angular velocity measuring means are summed to develop a difference signal that is applied as the input to a controller.

In order for the torque modulator to modulate the torque applied to the mechanical transmission, it must necessarily operate at less than its maximum rated torque. In other words, such modulation depends upon the existence of a certain amount of "slip" in the modulator. It is necessary, then, for the velocity of the line-speed-dependent roller or clutch shaft to be greater than the output angular velocity of the torque modulator by some amount designated "slip". Consequently, the difference signal is compared with a fixed reference signal that is set to be proportional to the desired maximum slip in the torque modulator means. The result is an error signal reflecting the deviation of the actual slip from the reference slip value. That error signal is applied to a conventional servopositioner which controls the gear-in ratio of the mechanical transmission driving the winding roll so as to maintain the desired amount of slip in the torque modulator. Thus, the tension control loop provides a signal to the torque modulator that represents the exact torque necessary to maintain the desired tension in the web. On the other hand, the slip of the torque modulator is a measure of the winding roll diameter for a given reference signal input to the mechanical transmission in the ratio control loop.

During winder operation, as the winding roll increases in diameter, its surface speed, and therefore, the tension in the web increase. This tension increase is reflected in motion of the dancer roller. That motion is sensed to develop a control signal for the torque modulator which causes its slip to increase proportionately. This increased slip produces an increase in the difference signal from the two tachometers and through the action of the ratio control loop, the gear-in ratio of the mechanical transmission is adjusted to return the slip to the desired preset amount resulting in a reduction in the speed of the winding roll. This process continues automatically so that the gear-in ratio of the transmission matches the continuously changing roll diameter resulting in an essentially constant tension input to the torque modulator. This is in marked contrast to the constantly varying torque requirement for changing roll diameter inherent in prior comparable winders of this general type. Of course, the apparatus also responds very quickly to a web tension upset detected by the dancer roller position sensor by applying a control signal to the torque modulator to appropriately adjust its slip to compensate for the tension upset without affecting the gear-in ratio of the slow responding mechanical transmission driving the roll.

Thus the present winder provides extremely close control over web tension because the tension control loop is extremely fast in its response. Further, the winder can operate with a motor sized to the expected horsepower requirement based upon the desired web tension and velocity for the particular application because the ratio control loop matches the motor characteristics to the winder drive characteristics for all expected roll diameters. Thus the present construction results in a cost saving because of the smaller motor frame size required to drive the winder and the reduced current carrying requirements of the motor control and drive circuitry. Further efficiencies result if the winder is operated from the prime mover of the web producing machine because power is recirculated mechanically to minimize power consumption.

BRIEF DESCRIPTION OF THE DRAWING

For a fuller understanding of the nature and objects of the invention, reference should be had to the following detailed description, taken in connection with the accompanying drawing which is a view partly in diagrammatic form and partly in block form showing web winding apparatus made in accordance with this invention:

DESCRIPTION OF THE PREFERRED EMBODIMENTS

Turning now to the drawing, a web W such as paper or plastic sheet issuing at substantially constant velocity from a web producing machine (not shown) such printing or laminating apparatus is guided in the direction indicated by the arrow to a web winder indicated generally at 10 where the web is wound up on a roll R. Winder 10 includes a dancer assembly shown generally at 11 through which web W passes on its way to roll R. Assembly 11 includes a pair of spaced, parallel idler rollers 12 and 14 and an intervening dancer roller 16 and the incoming web is trained over roller 12, under roller 16 and over roller 14 on its way to roll R.

Dancer roller 16 is mounted in a U-shaped frame 18 that is movable vertically relative to rollers 12 and 14. Frame 18 and thus roller 16 are force-loaded in the downward direction by means of a piston assembly 22. The amount of downward force exerted on frame 18 is determined by the setting of a variable pressure regulator 23 connected in the fluid line to piston assembly 22. Thus the setting of regulator 23 imparts a selected tension to web W. As long as that tension remains constant, the dancer roller 16 remains in a selected reference position P. However, any changes in web tension are reflected in movements of the dancer from that reference position. In other words, if there is an increase in web tension, the dancer roller moves up in opposition to the downward force provided by piston assembly 22. On the other hand, if there is a decrease in web tension, the piston assembly 22 moves roller 16 downward from its reference position.

Movements of the dancer from position P are detected by a conventional position sensor 24. For example, the sensor may be a potentiometer connected by an arm **24*a* to frame 18**. Excursions of the frame and its dancer roller are reflected as changes in the resistance value of the potentiometer.

The web roll R is wound on a core R′ which is, in turn, mounted for rotation with a spindle 32. Spindle 32 is connected for rotation with the output shaft **34*a* of a conventional variable speed mechanical transmission 34. Transmission 34 may be any type of transmission whose output shaft speed may be varied continuously relative to a selected input shaft 34*b*** speed by means of an appropriate control signal applied to the transmission. Preferably the transmission shoud have a relatively wide speed range and wide constant horsepower range. A suitable transmission is a Kopp Variator.

The input shaft **34*b* of transmission 34 is connected for rotation with the output shaft 36*a* of a torque modulator 36. In the illustrated example, modulator 36 is a variable slip torque clutch having an input shaft 36*b*. For example, clutch 36 may be a magnetic clutch, the amount of slip in the clutch being determined by the current applied to the clutch. The clutch 36 derives its input from the prime mover of the web producing machine so that shaft 36*b* carries a pulley 38 which is connected to that prime mover by a suitable endless belt 42. Thus the clutch input shaft 36*b*** is rotated at a speed which is a selected percentage of the speed of the prime mover.

The dancer roller 16 along with its position sensor 24, clutch 36, and the driven web roll R comprise a tension control loop. Deviations in the web tension from the set value are reflected as movements in the dancer roller 16 from its reference position P. These deviations are sensed by sensor 24 whose resistance value is applied to a torque controller 44. Controller 44 is a conventional circuit which develops a output current that is proportional to the resistance value from sensor 24. Desirably also, the controller includes a conventional current feedback network **44*a* to enhance the stability of the tension control loop. The current from controller 44 is applied to control the amount of slip in clutch 36 between its input and output shafts 36*b* and 36*a*** respectively, the amount of slip being inversely proportional to the applied current.

In order to monitor that slip, a pair of tachometers 46 and 48 measure the speeds of the clutch input and output shafts **36*b* and 36*a* respectively. Tachometer 46 is rotated by timing chain 54 trained around a sprocket 56 on shaft 36*b*. A similar chain and sprocket 58 and 62 respectively mechanically connect tachometer 48 to the output shaft 36*a*. Thus the tachometers 48 and 46 produce output voltages that are a measure of the clutch input and output shaft angular velocities. These voltages are the inputs to the system's ratio control loop. That loop includes a summing network 64 which subtracts the output voltage from tachometer 48 from that of tachometer 46 to develop a difference voltage. That difference voltage is compared in network 64 with a reference voltage provided by an adjustable voltage source 66. Source 66 is set to provide a fixed reference voltage which is proportional to the desired maximum slip in clutch 36, say, for example, 25 to 50 rpm. Thus the output from network 64 is an error signal which reflects the deviation of the actual slip in clutch 36 from the reference slip value set by voltage source 66. This error signal is applied to a ratio controller which thereupon develops a control signal for conventional servopositioner or other such actuator 74 in the ratio control loop. Actuator 74 includes an output shaft 74*a* which is connected to the ratio control input 34*c* of transmission 34. For stability purposes, feedback may be included across positioner 74 and indicated at 74*b***.

During normal operation of the winder, fluid regulator 23 is adjusted to set a selected amount of tension in the web W. Also the reference voltage source 66 is adjusted to provide for the desired maximum amount of slip in clutch 36. As the web winds up on roll R, any sudden tension upsets in the web caused, for example, by an eccentric roll core R′ are detected by dancer assembly 11. This results in the output current from controller 44 being adjusted as required to vary the amount of slip in clutch 36 as needed to speed up or slow down its output shaft **36*a* as required to speed up or slow down the output shaft 34*a* of transmission 34 sufficiently to return the dancer roller 16 to its reference position P and thus restore the proper tension to the winding web W. For example, if there is a sudden increase in web tension, dancer roller 16 rises resulting in a decrease in current applied to clutch 36. The clutch slip increases so that its output shaft 36*a* slows down relative to its iput shaft 36*b*. That reduced output angular velocity is immediately coupled by the transmission 34 to roll spindle 32 so that the surface speed of roll R is reduced sufficiently to reduce the web tension to the set value whereupon dancer roller 16** returns to its reference position P.

Conversely, if the tension upset decreases tension, clutch 36 is controlled to couple more torque to the roll so that its surface speed increases sufficiently to restore the correct tension in the web.

It is important to note that the compensation for web tension upsets in the foregoing fashion involves no change whatsoever in the gear-in ratio of transmission 34. Thus the present rewinder is able to compensate for sudden tension upsets in web W independently of the speed of response of the mechanical transmission 34 which in most cases is too slow to maintain adequate control over web tension.

As the diameter of roll R increases during roll build-up, the surface speed of the roll tends to increase gradually causing a gradual increase in web tension. This gradual tension increase component is also sensed by dancer assembly 11 resulting in a gradual decrease in the control current applied to clutch 36. Thus during roll build-up, the amount of slippage in clutch 36 tends to increase gradually. Consequently, the difference between the voltages from tachometers 46 and 48 increases so that network 64 produces an error signal equal to the difference between the difference voltage and the reference voltage from source 66. The error signal is applied to controller 72 whose output drives actuator 74 as needed to move the transmission control 34*c* to continuously adjust the gear-in ratio of the transmission to compensate for the continuously changing diameter of roll R. In other words, the output shaft 34*a* of transmission 34 is slowed down so as to substantially eliminate the increased web tension component due to increased roll diameter. The elimination of that component tends to eliminate the component of dancer roller 16 movement caused by the increase in roll diameter.

It should be appreciated that the web tension change due to increasing roll diameter is much more gradual than a tension change caused by a typical tension upset. Consequently, even though the system's ratio control loop has a relative slow response, it can compensate for the former tension change without in any way interfering with the ability of the system, through its fast-response tension control loop, to compensate immediately for the usual sudden tension upsets due to roll core eccentricity, worn bearings and the like.

Also, since the system's ratio control loop matches the winder's speed characteristics at the input of the mechanical transmission 34 to the clutch 36 characteristics at all roll diameters, the clutch 36 need only be able to handle the expected web horsepower requirement in terms of web tension and speed. No longer does the clutch have to be oversized to handle the widely varying web speed and torque requirements at both roll diameter extremes.

Some applications, it is desirable to wind web W on roll R at a higher web tension near the roll core R′ than at the surface of the roll. In a typical case, the ratio of the web tensions at the outer and inner roll diameters may be on the order of 1.5 to 2. In the present apparatus, such tension taper can be imparted to the web automatically by decreasing the force-loading by piston assembly 22 on dancer roller 16 in proportion to roll diameter. More particularly, since the output of controller 72 is directly proportional to roll diameter, that output can be applied by way of an electrical lead shown in dotted lines at 75 to control the pressure regulator 23 so that the piston assembly 22 gradually applies less force to the dancer roller as the roll size increases.

Also, while the torque modulator 36 as shown is a clutch, a DC motor whose torque is proportional to applied current and operating independently from the prime mover could just as well be used to drive transmission 34. In this event, a reference speed signal may be provided by a tachometer shown in dotted lines at 76 rotated by a fixed diameter web driven roller, such as roller 12, along the path to roll R. The output of tachometer 74 is then applied by a lead 77 (dotted line) to summing network 64 in lieu of the output voltage from the illustrated tachometer 46. This alternative mode of operation is conveniently indicated by the inclusion of a two position switch 78 at the input to network 64 and a motor shown in dotted lines at 80 whose output shaft is connected to rotate transmission input shaft 34*b*.

As will be appreciated from the foregoing, then, the present winding apparatus provides close control over web tension when the winding roll R is very small as well as when it nears its maximum diameter. Furthermore, this accurate control is achieved using a torque modulator such as a motor or clutch whose size depends only upon the expected horsepower required to maintain the selected web tension and speed of the building web roll R in the particular application. Accordingly, that modulator as well as the ancillary circuitry required to control it are more compact and less costly than prior comparable winder drives used for this purpose which have to satisfy both the torque and speed requirements at all roll diameters.

It will thus be seen that the objects set forth above, among those made apparent for the preceding description, are efficiently attained, and since certain changes may be made in the above constructions without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. Web winding apparatus comprising

A. means for rotatively supporting a web roll;

B. a variable speed transmission having an input shaft and an output shaft connected to rotate the roll support means;

C. means for changing the gear-in ratio of the transmission in response to an input signal;

D. a torque coupling device for rotating the transmission input shaft, the torque coupling of the device being controllable in response to a control signal;

E. means for sensing the tension in the winding web to produce a control signal for the coupling device so that the angular velocity of the roll support means is varied to compensate for tension upsets in the web; and F. means for matching the winder's speed characteristics at the input shaft of the transmission to the torque coupling device characteristics at all roll diameters so that the winder requires only a minimum size torque coupling device for given web speed and tension conditions.

2. The apparatus defined in claim 1 wherein the matching means comprise

A. means for detecting the amount of torque coupling in said coupling device, and B. means for comparing said coupling amount with a reference amount to produce an input signal for the changing means so that the transmission reduces the angular velocity of the roll support means to compensate for the gradually increasing tension caused by increasing winding roll diameter.

3. The apparatus defined in claim 2 wherein the web tension sensing means includes A. a movable dancer roller around which the winding web is trained;

B. means for biasing the dancer roller to a selected reference position for a given web tension condition; and C. a position sensor for producing a control signal for the coupling device when the dancer roller moves away from its reference position.

4. The apparatus defined in claim 1 wherein the torque coupling device comprises A. a variable slip clutch having an input shaft and an output shaft connected to the transmission input shaft; and B. means for rotating the clutch input shaft at a rate proportional to the speed of the web being wound by the winding apparatus.

5. The winding apparatus defined in claim 4 wherein the torque coupling detecting means comprise a pair of angular velocity sensors driven by the clutch input and output shafts.

6. The web winding apparatus defined in claim 1 wherein the torque coupling device comprises a DC motor having an output shaft whose torque varies in accordance with the control signal applied to the motor.

7. The web winding apparatus defined in claim 6 wherein the matching means comprises A. means for sensing the angular velocity of the motor shaft to develop a first signal;

B. means for sensing the speed of the web to the winding apparatus for producing a second signal; and C. means for comparing the first and second signals.

8. Web winding apparatus comprising

A. means for rotatively supporting a web roll;

B. means for guiding web from a web producing machine toward the supporting means, said guiding means including a movable dancer;

C. means for force-loading the dancer so that it tends to assume a reference position with a selected tension in the web;

D. means for detecting movements of the dancer roller away from its reference position and developing a control signal in response thereto;

E. means for rotating the roll supporting means, said rotating means comprising 1. a variable speed mechanical transmission having an input shaft and an output shaft connected to the roll support means and means for controlling the output versus input speed ratio of the transmission, and 2. torque modulating means connected to apply torque to the transmission input shaft in accordance with a control signal applied to the modulating means;

F. means responsive to the output of the dancer position sensing means for applying a control signal to the torque modulating means so as to vary the output angular velocity of the torque modulating means relative to a reference angular velocity proportional to the line speed of the web to the winding apparatus so as to vary the angular velocity of the roll support means as needed to maintain substantially constant tension in the web being wound in a roll supported by the roll supporting means;

G. means for producing a difference signal proportional to the difference between the output angular velocity of the torque modulating means and said reference angular velocity;

H. means for producing a reference signal proportional to a selected said angular velocity difference;

I. means for comparing the difference signal and the reference signal to develop an error signal, and J. means for applying the error signal to the transmission control means so as to vary the transmission output versus input shaft speed ratio so as to minimize the error signal from the comparing means.

* * * * *